United States Patent [19]

Umemoto et al.

[11] 4,154,061

[45] May 15, 1979

[54] FABRIC FORMS FOR CONCRETE

[75] Inventors: Tomoji Umemoto, Nagoya; Yukichi Nakamura, Tokyo, both of Japan

[73] Assignee: Construction Techniques, Inc., Cleveland, Ohio

[21] Appl. No.: 817,572

[22] Filed: Jul. 21, 1977

[51] Int. Cl.[2] ..... E02B 3/12

[52] U.S. Cl. ..... 405/19; 139/384 R; 139/387 R

[58] Field of Search ..... 139/384 A, 387 R, 388, 139/425 R, 425 A, 408, 409, 410; 61/37, 38, 39

[56] References Cited

U.S. PATENT DOCUMENTS

| | | | |
|---|---|---|---|
| 3,524,320 | 8/1970 | Turzillo | 61/38 |
| 3,565,125 | 2/1971 | Hayes | 139/410 |
| 3,711,627 | 1/1973 | Maringulov | 139/425 R |
| 3,811,287 | 5/1974 | DeWinter | 61/38 |

*Primary Examiner*—Henry Jaudon

[57] ABSTRACT

A fabric and containers constructed therefrom, formed of interwoven warp and weft yarns, characterized by a plurality of continuous reinforcing means woven into the fabric at spaced intervals among and parallel to the warp or weft yarns, or both, each reinforcing means comprising a plurality of periodically spaced unwoven sections lying on one or both sides of and in juxtaposition with the fabric.

9 Claims, 12 Drawing Figures

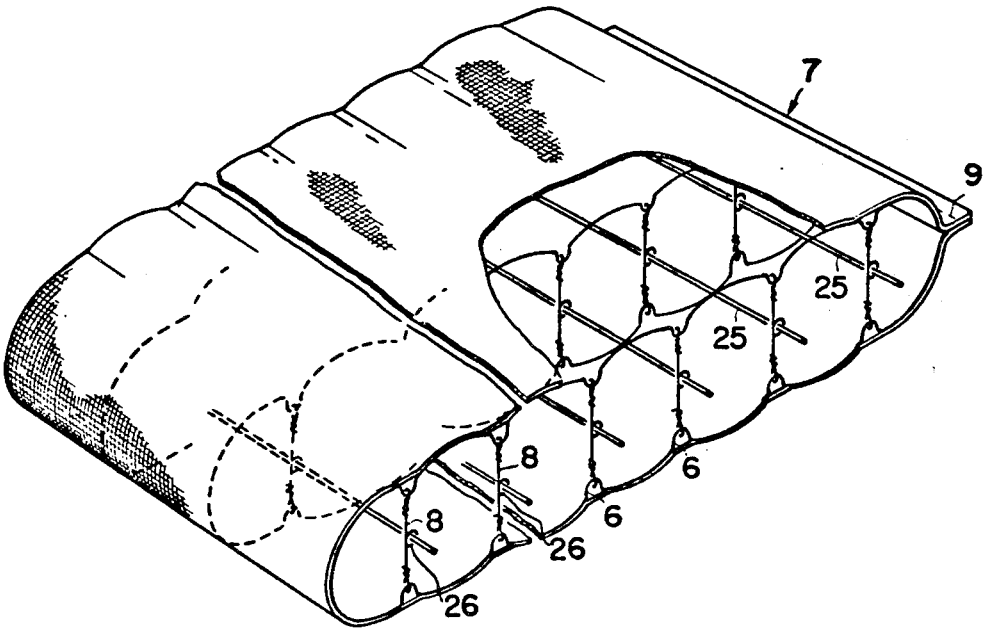

FABRIC FORMS FOR CONCRETE

INTRODUCTION

This invention relates to the fabric art and to forms constructed of fabric which may be filled with concrete and other flowable substances. Such forms find utility in erosion control applications, and may be found installed on river banks, channel floors, coast lines and the like.

BACKGROUND OF THE INVENTION

Fabric forms, and fabrics for making the same have been receiving a considerable amount of attention from innovators, as evidenced for example, by the issuance of U.S. Pat. Nos. 3,486,341; 3,524,320; 3,570,254; 3,517,707; and 3,837,169.

Most of the inventive effort as reflected in these patents, has been directed to the provision of restraining means to limit and control the thickness of the forms as they are filled with concrete. There are at least three reasons why controlled thickness is important. First, it conserves filler material. Second, it produces an aesthetically pleasing surface configuration. Third, in some instances, it allows a measure of predictable control of cracking of the concrete monolith within the form, in cases where heaving and settling create forces which exceed the elastic limit of the concrete structure. This controlled cracking is desirable since it permits the concrete structure to conform itself to changing profiles in the underlying, river bank, channel floor, coast line or the like.

In some of the earlier efforts, as evidenced by U.S. Pat. Nos. 3,486,341; 3,524,320; and 3,570,254, uniformly spaced wire ties were employed to limit the thickness of the fabric form.

In U.S. Pat. No. 3,517,707 "drop stitches" were woven into a dual layer fabric, to extend from one layer of fabric to the other, and thereby limit the distance by which the two layers of fabric could be separated.

U.S. Pat. No. 3,837,169 employs cord systems disposed internally of the fabric form to limit its cross-section and configuration.

While each of the systems employed by the prior art is useful, no one is without its drawbacks. Thus, for example, the network of wires disclosed by U.S. Pat. No. 3,524,320 is tedious to install and expensive from the standpoint of the amount of hand labor involved.

The "drop stitch" arrangement disclosed in U.S. Pat. No. 3,670,504 while desirable from a standpoint that virtually no on-site construction is required, suffers the disadvantage that the number of drop stitches required to achieve the thickness control is so great that the crisscrossing fibers tend to impede the flow of concrete within the fabric container, making it difficult to fill the form.

U.S. Pat. No. 3,837,169 by its disclosure constitutes an improvement over the foregoing prior art techniques, and indeed overcomes many of the problems associated with the earlier thickness control systems. The present invention moves one step further in the direction of reducing the amount of hand labor required to install the means for controlling the thickness of the form, while maintaining the interior of the form relatively uncluttered to permit the movement of flowable concrete without significant impediment.

SUMMARY OF THE INVENTION

It is therefore an object of the present invention to provide a fabric suitable for use in the manufacture of forms for concrete or the like, which overcome some of the problems associated with prior art fabrics designed for such applications.

It is another object of the invention to provide a form for concrete employing the novel fabric, wherein there is provided a simple but effective system for controlling the thickness of the form while minimizing the internal obstructions within the form.

Still another object of the invention is the provision of a multi-compartment form whereby forms having total thicknesses exceeding those readily achievable by prior art means, can be easily obtained by incrementally controlling the thickness of successive compartments within the fabric form.

In brief and in general terms, these objects of the invention are obtained by weaving a portion of the thickness control means into the fabric as it is manufactured, and then installing the remaining portion of the thickness control means as the fabric is manufactured into a form, on the job site or elsewhere, to meet whatever thickness specifications are called for by a particular installation. This reduces the amount of labor and time involved in installing the thickness control system when compared with the installation of a system which is completely separate and independent of the fabric. Further, since the system of the present invention does not employ "drop stitches" crisscrossing from one layer of fabric to another, as described in U.S. Pat. No. 3,517,707, the problem of clutter attendant the use of drop stitches is also avoided.

More specifically, and in accordance with one aspect of the present invention, there is provided a generally planar fabric suitable for use in the manufacture of forms for concrete or the like, in which the fabric is composed of interwoven weft yarns and warp yarns, the improvement comprising a plurality of continuous reinforcing means woven into the fabric at spaced intervals among and parallel to the weft yarns, or the warp yarns, or both, each reinforcing means comprising a plurality of periodically spaced unwoven sections lying on one or both sides of and in juxtaposition with the fabric.

In accordance with another aspect of the invention, there is provided a form for concrete or the like comprising at least an upper and a lower reach of generally planar fabric of the type described above, wherein the reaches are joined at their peripheries to define a fabric container, their being woven into each of the reaches of fabric a plurality of the aforedescribed reinforcing means comprising a plurality of periodically spaced unwoven sections lying on one side of and in juxtaposition with the fabric. In accordance with a preferred embodiment, the unwoven sections lying one and in juxtaposition with one side of the upper and lower reaches of the fabric are vertically disposed with respect to each other in a line generally perpendicular to the plane of the fabric, and there are provided inelastic means interconnecting at a finite distance apart, at least some of the vertically aligned unwoven sections.

In accordance with still another aspect of the invention, there is provided a multi-compartment form for concrete or the like comprising an upper reach, at least one intermediate reach, and a lower reach of generally planar fabric of the type described above. The reaches are joined at their peripheries to define a multi-compartment fabric container. Woven into each reach are a plurality of continuous reinforcing means, each comprising a plurality of spaced, interwoven sections lying on and in juxtaposition with the sides of the fabric defining the interior of the compartments, and inelastic means are provided, interconnecting at a finite distance apart at least some of the unwoven sections associated with the different reaches of fabric.

These and other objects, features and advantages of the present invention will become readily apparent to one skilled in the art upon consideration of the following detailed description and accompanying drawings of the preferred embodiments of the invention, which includes the best mode presently contemplated for practicing the invention.

BRIEF DESCRIPTION OF THE DRAWINGS

Referring to the drawings wherein like reference numerals indicate like parts in the various views:

FIG. 11 is a pictorial perspective view of a form in accordance with the present invention as it appears when filled with concrete or the like.

DESCRIPTION OF THE PREFERRED EMBODIMENT

Figure 1:
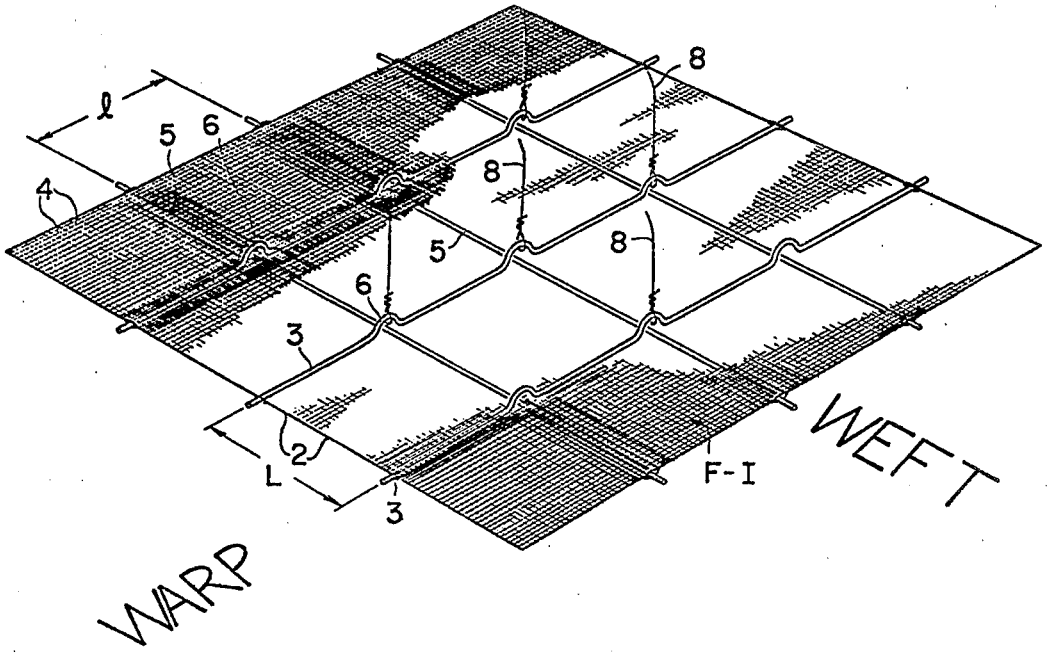
FIG. 1 is a perspective view of a portion of fabric in accordance with the present invention.

FIG. 1 illustrates a generally planar fabric designated generally as F-I, suitable for use in the manufacture of forms for concrete or the like in accordance with the present invention.

The fabric is composed of interwoven warp yarns indicated generally as 2 and weft yarns indicated generally as 4.

For purposes of this disclosure, the term "yarn" is intended to embrace slit film as well as assemblages of fibers or filaments whether spun, twisted, or merely laid together to form a continuous strand. The yarns may be formed from a wide variety of natural and synthetic, organic and inorganic materials, of which synthetic organic materials are generally preferred. Particularly suitable are yarns formed of polyester, polyamide and polypropylene resins.

In the embodiment illustrated in FIG. 1, there are provided at spaced intervals among, and parallel to warp yarns 2, a plurality of continuous reinforcing means 3 each comprising a plurality of periodically spaced unwoven sections 6 lying on one side of and in juxtaposition with fabric F-I. Continuous reinforcing means 3 are woven as warp yarns, and in the preferred embodiment illustrated, are yarns which are heavier and stronger than warp yarns 2. The configuration of unwoven sections 6 in which reinforcing means 3 float over a plurality of weft yarns is greatly exaggerated for clarity of illustration.

Figure 1A:
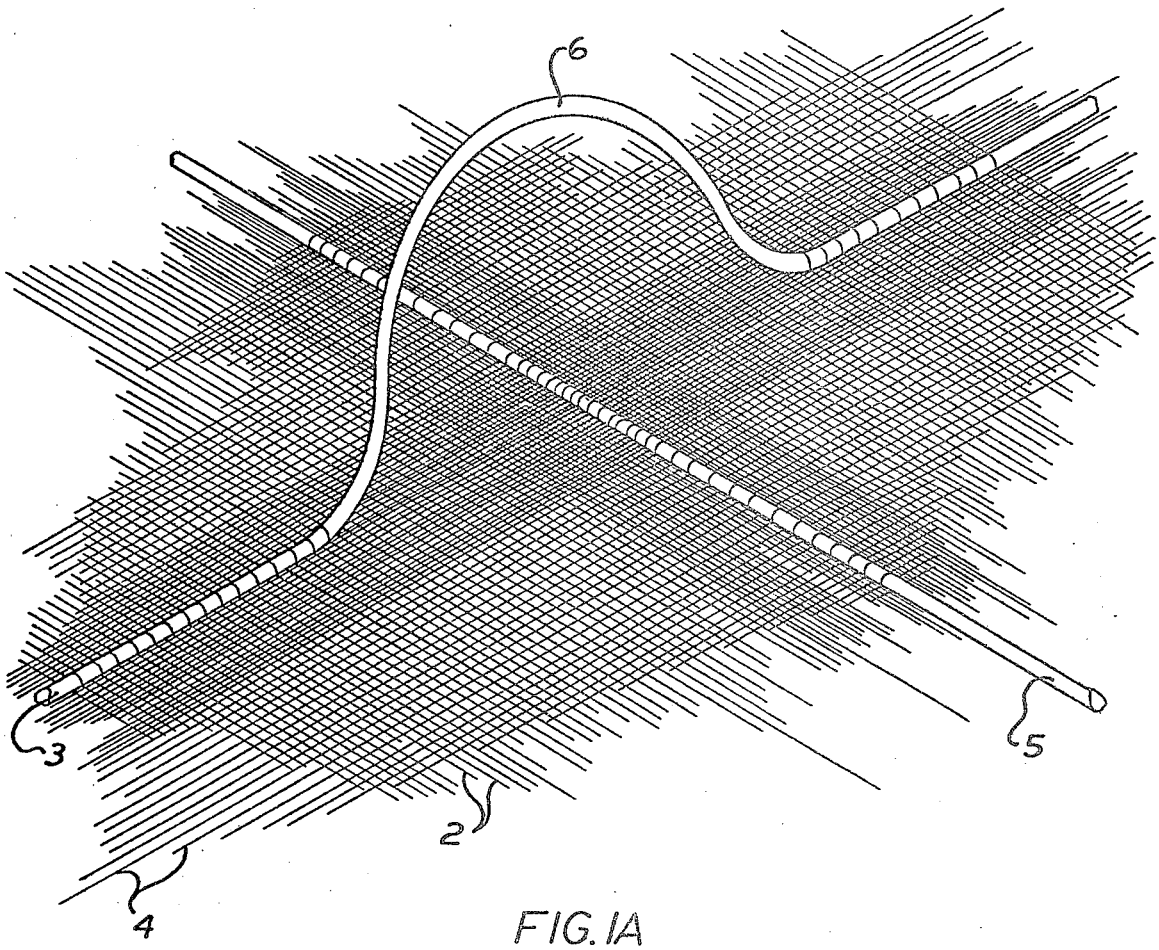
FIG. 1A is a greatly enlarged perspective view of a small portion of the fabric illustrated in FIG. 1.

As best illustrated in FIG. 1A, reinforcing means 3 may be woven among the warp yarns in the same pattern as are the warp yarns, which pattern in the embodiment illustrated is a simple weave, i.e., a warp yarn is woven above one weft yarn and below the next.

The fabric F-I in FIG. 1 is further provided with a plurality of continuous stabilizing means 5, which in the embodiment illustrated take the form of yarns woven as weft yarns into and coplanar with fabric F-I, and spaced at intervals among and parallel to weft yarns 4. As the name implies, stabilizing means 5 are designed to provide the fabric with dimensional stability under the forces exerted when the fabric, formed into a container, is filled with concrete or the like.

As best illustrated in FIG. 1A, stabilizing means 5 may be woven among the weft yarns in the same pattern as are the weft yarns, which pattern in the embodiment illustrated is a simple weave, i.e., a weft yarn is woven above one warp yarn and below the next.

Stabilizing means 5 are heavier and stronger then weft yarns 4 and may be identical in size and strength to the heavier yarns forming continuous reinforcing means 3.

In the embodiment illustrated in FIG. 1, continuous reinforcing means 3 are uniformly spaced apart a distance L, and stabilizing means 5 are uniformly spaced apart a distance 1.

Attached to unwoven sections 6 of continuous reinforcing means 3 are inelastic means which may take the form of wire, strands, yarns, filaments, rods or the like formed of organic or inorganic materials including metals. In the embodiment illustrated, the inelastic means takes the form of metal wires 8 secured to at least some of the unwoven sections 6. The function of wires 8 will be described presently.

As a variation of the configuration of fabric illustrated in FIG. 1 the present invention contemplates providing an alternating array of continuous stabilizing means and continuous reinforcing means in the warp direction, the weft direction or both.

Reinforcing means 3 and stabilizing means 5 are, for the sake of simplicity and ease of understanding, shown in the drawings and referred to in these specifications as single discrete yarns or cords substantially heavier in weight than those yarns comprising the body of the fabric, i.e., the weft and warp yarns. As an alternate to the use of such discrete elements, yarn count may be simply increased in the area of these reinforcing and stabilizing means and the extra yarns allowed to float free of the body fabric to form unwoven sections 6.

It is also contemplated, as illustrated in FIG. 1, to increase the warp and weft count in the vicinity of reinforcing means 3 and stabilizing means 5 for added strength.

Figure 2:
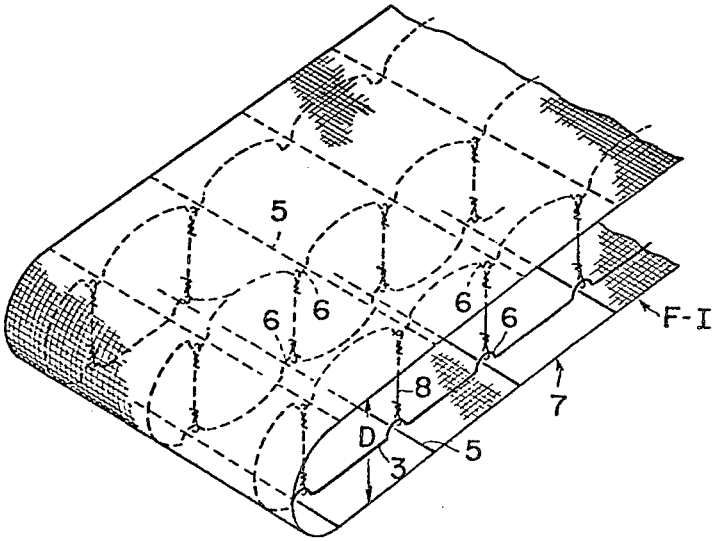
FIG. 2 is a perspective view of a portion of fabric in accordance with the present invention folded back upon itself to form upper and lower reaches of fabrics.

FIG. 2 illustrates a first step in a preferred method of forming a container from fabric F-I. This involves folding the fabric upon itself to form a lower reach *7a* and an upper reach *7b*. It will be appreciated that, alternatively, the two reaches can be formed from separate, discrete sections of fabric.

In actual practice, it is convenient to attach wires 8 to the spaced unwoven sections 6 on lower reach *7a* before the fabric is folded upon itself. Further, it is convenient to fold the fabric back on itself incrementally and to secure in moving sequence with the folding of the fabric, the distal ends of wires 8, to the unwoven sections associated with the upper reach *7b* of the fabric.

As well illustrated in FIG. 2 unwoven sections 6 associated with upper reach *7b* of the fabric are vertically disposed above corresponding unwoven sections associated with lower reach *7a* of the fabric, in a line generally perpendicular to the plane of the fabric F-I. Wires 8, interconnect such unwoven sections at a finite distance apart D, which limits the distance reaches *7a* and *7b* can be separated even under the forces exerted when the finished container is filled with concrete or the like.

As the next step in the forming of the fabric container, the open peripheries of reaches *7a* and *7b* are joined together by stitching, stapling or other means. In the preferred embodiment illustrated in FIGS. 3 and 4, the peripheries are joined to each other by means of stitches 9.

As the final step in the preparation of the fabric container, a suitable opening is provided in one of the reaches of fabric, for example, illustrated orifice *9a*, for the insertion of a pipe (not shown) or the like, to admit concrete or other fluid material into the container.

Figure 3:
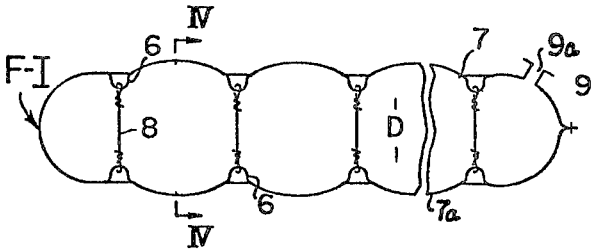
FIG. 3 is a vertical section view of the fabric container formed by joining the peripheries of the upper and lower reaches of fabric illustrated in FIG. 2.
Figure 4:
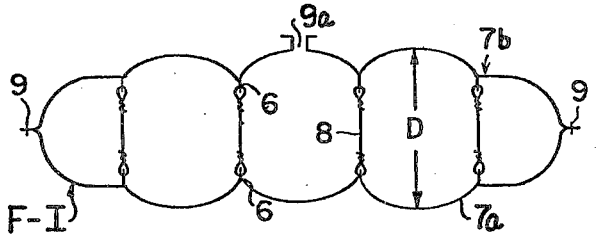
FIG. 4 is a sectional view taken generally along line 4—4 of FIG. 3.

As can be visualized from FIGS. 3 and 4 (see also FIGS. 10 and 11), the thickness D of the container is limited by the coaction of wires 8 with unwoven portions 6 associated respectively with lower reach *7a* and upper reach *7b*. At the same time it will be noted that wires 8 interfere only minimally with the flow of fluid concrete through the interior of the container.

Figure 5:
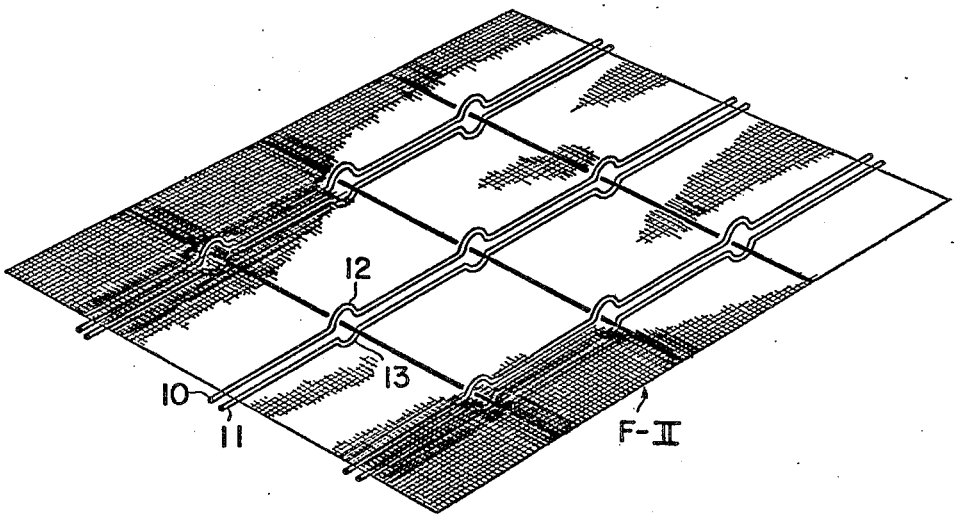
FIG. 5 is a perspective view of a second embodiment of fabric in accordance with the present invention.

FIG. 5 shows a modification of the present invention wherein a fabric F-II is provided with two series of continuous reinforcing means 10, 11. The first series, consisting of a plurality of continuous reinforcing means 10, comprise a plurality of periodically spaced unwoven sections 12 lying on and in juxtaposition with the upper surface of fabric F-II as viewed in FIG. 5. The second series, consisting of a plurality of continuous elements 11, comprises a plurality of periodically spaced unwoven sections 13 lying on and in juxtaposition with the lower surface of the fabric, as viewed in FIG. 5.

The sections of the continuous reinforcing means bridging the unwoven sections may be woven among and in the same pattern as the yarn forming the fabric, in the manner illustrated in FIG. 1A.

Figure 6:
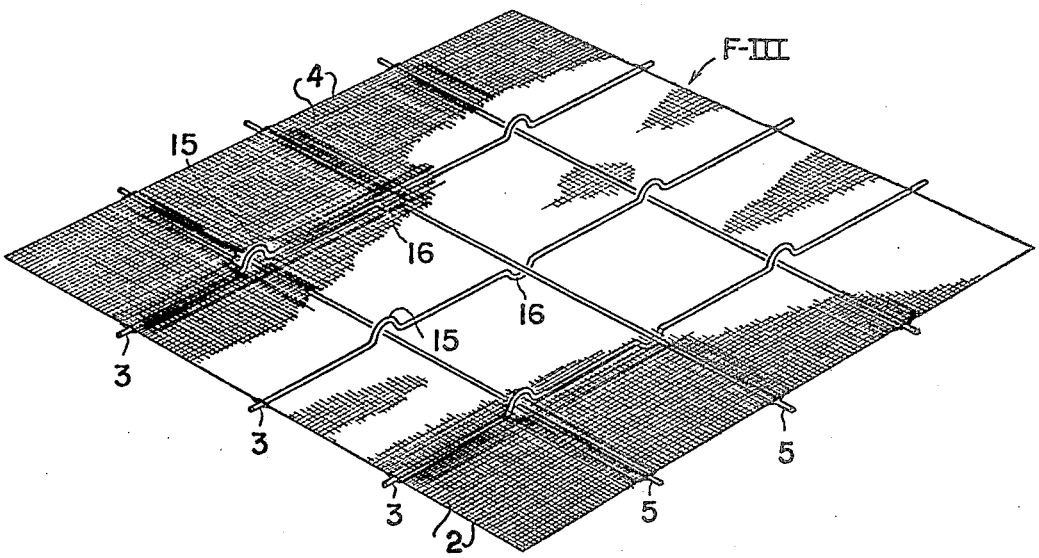
FIG. 6 is a perspective view of a third embodiment of fabric in accordance with the present invention.

FIG. 6 shows a further embodiment of the invention wherein fabric F-III is provided with a plurality of continuous reinforcing means 3 woven as warp yarns into the fabric at spaced intervals among and parallel to the warp yarns 2 of the fabric, and a plurality of stabilizing means 5 woven as weft yarns into the fabric at spaced intervals among and parallel to the weft yarns 4 of the fabric.

Each of the continuous reinforcing means 3 comprises a plurality of periodically spaced unwoven sections each of which floats over a plurality of weft yarns, and which lie alternately on and in juxtaposition with opposite surfaces of fabric F-III. Thus, unwoven sections 15 lie on and in juxtaposition with the upper surface of the fabric as illustrated in FIG. 6, and unwoven sections 16 lie on and in juxtaposition with the lower surface of the fabric as illustrated in FIG. 6.

The woven sections of the reinforcing means may be woven among and in the same pattern as the yarns forming the fabric, in the manner illustrated in FIG. 1A.

Figure 7:
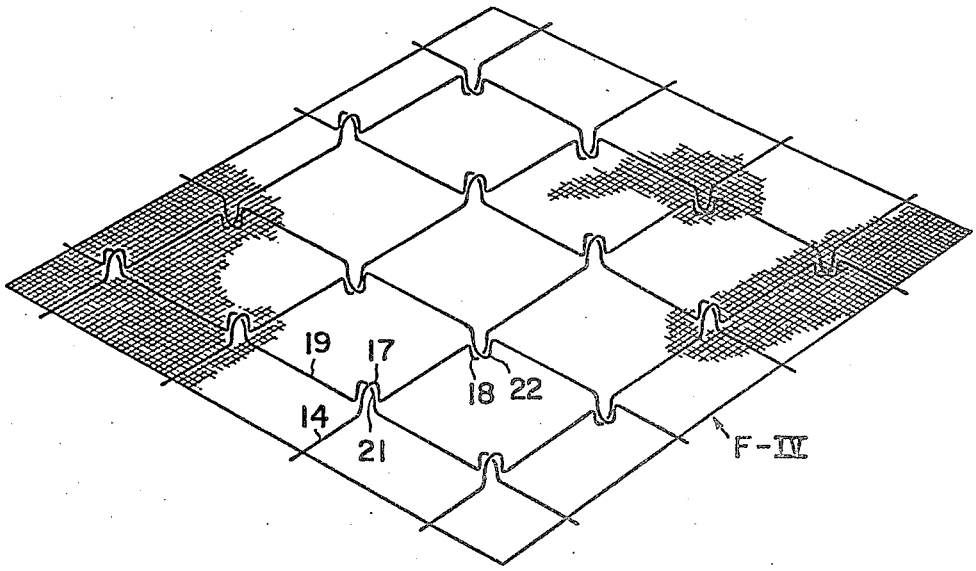
FIG. 7 is a perspective view of a fourth embodiment of fabric in accordance with the present invention.

FIG. 7 shows yet another embodiment of the present invention wherein fabric F-IV is provided with a plurality of continuous reinforcing means 14 woven as warp yarns into the fabric at spaced intervals among, and parallel to warp yarns 2 of the fabric, and a plurality of continuous reinforcing means 19 woven as weft yarns into the fabric at spaced intervals among and parallel to weft yarns 4 of the fabric.

Continuous reinforcing means 14 comprise periodically spaced unwoven sections 17, 18, each of which floats over a plurality of weft yarns, and which lie alternately on and in juxtaposition with the upper and lower surfaces of fabric F-IV as illustrated in FIG. 7. Continuous reinforcing means 19 comprise periodically spaced unwoven sections 21, 22, each of which floats over a plurality of warp yarns, and which lie alternately on and in juxtaposition with the upper and lower surfaces of fabric F-IV. It will be seen that unwoven sections 17 and 21, both of which lie on and in juxtaposition with the upper surface of the fabric, intersect, as do unwoven sections 18 and 22, both of which lie on and in juxtaposition with the lower surface of the fabric.

The woven sections of the reinforcing means may be woven among and in the same pattern as the yarns forming the fabric, in the manner illustrated in FIG. 1A. It will be noted that in this embodiment, the extra count of warp and weft yarns in the vicinity of the reinforcing means has been dispensed with.

The embodiments illustrated in FIGS. 5, 6 and 7 are useful as intermediate reaches of fabric in the construction of a multi-compartment form for concrete as will now be described in greater detail.

Figure 8:
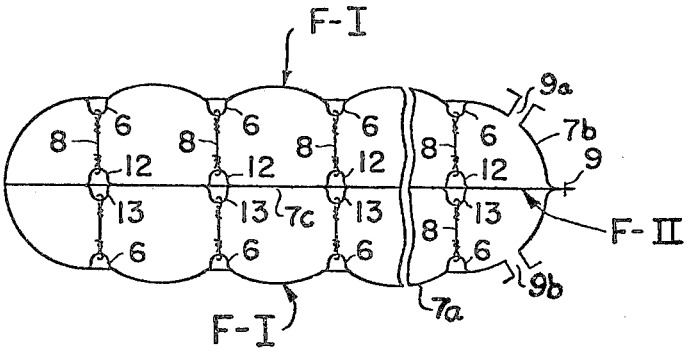
FIG. 8 is a vertical section view of a multi-compartment fabric container in accordance with the present invention.

FIG. 8 illustrates a multi-compartment form comprising lower reach *7a* of fabric F-I (see also FIG. 1), upper reach *7b* of fabric F-I, and intermediate reach *7c* of fabric F-II (see also FIG. 5). One compartment is defined by the space between upper reach *7b* and intermediate reach *7c*, and the other compartment is defined by the space between intermediate reach *7c* and lower reach *7a*. With attention direction to the upper compartment as viewed in FIG. 8, it will be seen that unwoven sections 6 lie on and in juxtaposition with the surface of reach *7b* defining the interior of the upper compartment while unwoven sections 12 lie on and in juxtaposition with the surface of reach *7c* defining the interior of the upper compartment. These vertically disposed unwoven sections which lie in a line generally perpendicular to the plane of fabrics F-I and F-II, are interconnected a finite distance apart by wires 8.

In a similar manner, unwoven sections 13 lie on and in juxtaposition with the surface of reach *7c* defining the interior of the lower part compartment as viewed in FIG. 8, while unwoven sections 6 lie on and in juxtaposition with the surface of reach *7a* defining the interior of the lower compartment as viewed in FIG. 8. These vertically disposed unwoven sections, which lie generally perpendicular to the plane of the fabrics F-I and F-II are interconnected at a finite distance apart by wires 8.

Each of the compartments is provided with orifice *9a* adapted to receive a hose or the like (not shown) for filling each compartment with fluid concrete or the like. The preferred procedure is to fill the lower compartment first, plug the orifice, and after the concrete has at least partially set, the upper compartment is then filled.

Figure 9:
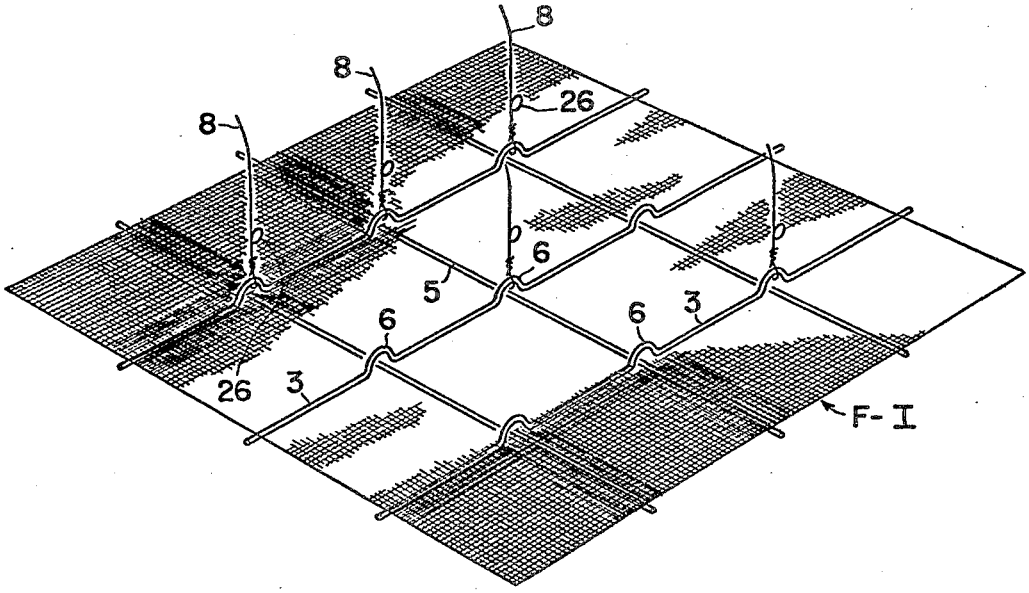
FIG. 9 is a perspective view of fabric illustrated in FIG. 1 with certain additional features added.

In some instances, it is desirable to provide supplemental reinforcing elements, for example, reinforcing bars or rods to lend additional strength to the formed concrete. To this end, and with reference to FIG. 9, wires 8 are provided with means, which in the embodiment illustrated take the form of loops 26 for engaging elongated reinforcing elements such as rods 25 (FIG. 10), to be disposed in a plane generally parallel to and intermediate the upper and lower reaches of fabric.

Figure 10:
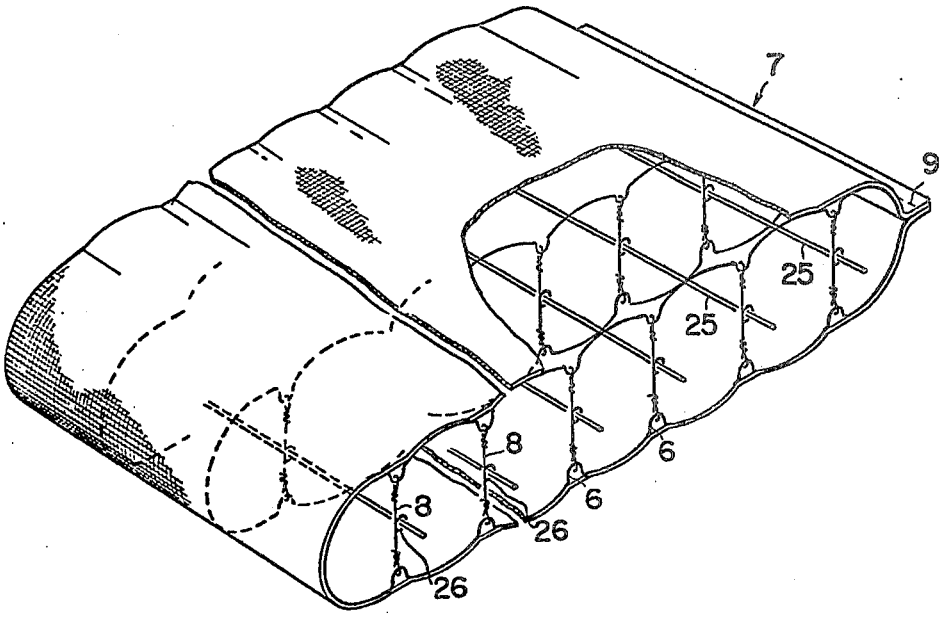
FIG. 10 is a pictorial view with parts in section of a form for concrete in accordance with the present invention.
Figure 11:
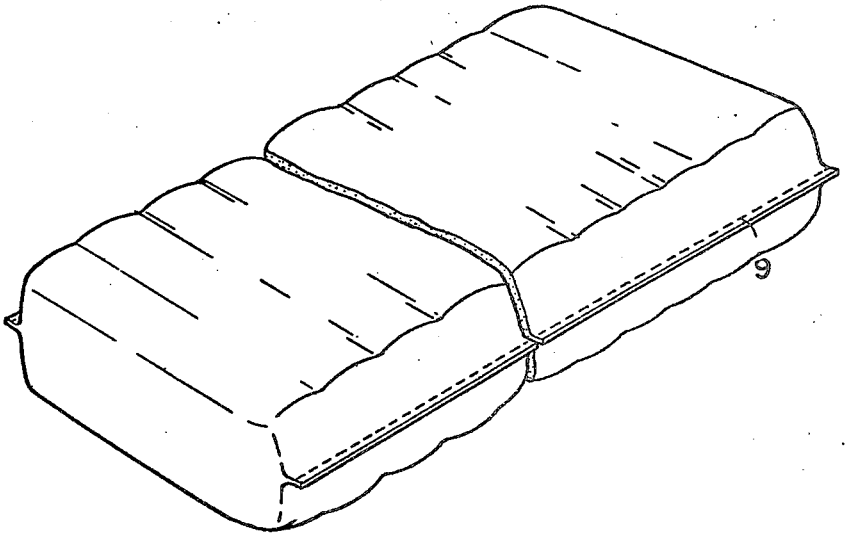

With reference to FIG. 10, as the form is constructed, rods 25 are inserted sequentially into aligned loops 26, and as the fabric container is filled with concrete or the like, the rods will automatically position themselves in a plane generally parallel to and intermediate the upper and lower reaches of fabric.

Throughout the disclosure, reference has been made to continuous reinforcing and stabilizing means being woven into the fabric. While economics dictate that these elements and stabilizing yarns be woven in the same style or pattern as the warp and weft yarns forming the fabric, this is not a requirement of the invention. The continuous reinforcing and stabilizing means may be woven in a different style or pattern from the warp and weft yarns.

Having thus described our invention, we claim:

1. A form for concrete or the like comprising at least an upper and a lower reach of generally planar fabric formed of interwoven weft and warp yarns, said reaches being joined at their peripheries to define a fabric container having inner and outer surfaces, a plurality of reinforcing means woven into each of the upper and lower reaches of fabric, said means being disposed at spaced intervals among and parallel to at least one of said weft yarns and said warp yarns thereof, each of said continuous reinforcing means comprising periodically spaced unwoven sections lying on and in juxtaposition with the surfaces of said upper and lower reaches of fabric defining the inner surfaces of the resultant fabric container.

2. The form defined in claim 1 wherein said spaced unwoven sections lying on and in juxtaposition with a surface of the upper reach of fabric are vertically disposed above the spaced unwoven sections lying on and in juxtaposition with a surface of the lower reach of fabric in a line generally perpendicular to the plane of the fabric.

3. The form defined in claim 2 wherein there are provided inelastic means interconnecting at a finite distance apart at least some of the unwoven sections associated with the lower reach of fabric with corresponding, vertically disposed unwoven sections association with the upper reach of fabric.

4. The form defined in claim 3 wherein said inelastic means is provided with means for engaging elongated, reinforcing elements to be disposed in a plane generally parallel to and intermediate the upper and lower reaches of fabric.

5. The form defined in claim 2 wherein said continuous reinforcing means are woven into said upper and lower reaches of fabric at spaced intervals among and parallel to one of said weft yarns and said warp yarns, and there are provided a plurality of stabilizing means woven into and coplanar with said reaches of fabric at spaced intervals among and parallel to the other of said weft yarns and said warp yarns.

6. A multicompartment form for concrete comprising an upper reach, at least one intermediate reach and a lower reach of generally planar fabric, each formed of interwoven weft and warp yarns, said reaches being joined at their peripheries to define a multicompartment fabric container, a plurality of continuous reinforcing means woven into each of said reaches of fabric, said reinforcing means being disposed at spaced intervals among and parallel to at least one of said weft yarns and said warp yarns thereof, each of said continuous reinforcing means woven into said upper and lower reaches of fabric comprising spaced unwoven sections lying on and in juxtaposition with a side of said upper and lower reaches of fabric defining interior surfaces of a compartment, said continuous reinforcing means woven into said at least one intermediate reach of fabric comprising spaced unwoven sections lying on and in juxtaposition with both sides of said at least one intermediate reach of fabric.

7. The multicompartment form for concrete defined in claim 6 wherein there is provided one intermediate reach of fabric.

8. The multicompartment form for concrete defined in claim 7 wherein said unwoven sections associated with the upper reach of fabric are vertically disposed above at least some of the spaced unwoven sections associated with the intermediate reach of fabric, in a line generally perpendicular to the plane of the fabric, and the spaced unwoven sections associated with the lower reach of fabric are vertically disposed below at least some of the spaced unwoven sections associated with the intermediate reach of fabric, in a line generally perpendicular to the plane of the fabric.

9. The multicompartment form for concrete defined in claim 8 wherein there are provided inelastic means interconnecting at a finite distance apart, (a) at least some of the unwoven sections associated with the intermediate reach of fabric with corresponding, vertically disposed unwoven sections associated with the upper reach of fabric, and (b) at least some of the unwoven sections associated with the lower reach of fabric with corresponding, vertically disposed unwoven sections associated with the intermediate reach of fabric.

* * * * *